US007066845B2

(12) United States Patent
Joseph

(10) Patent No.: US 7,066,845 B2
(45) Date of Patent: Jun. 27, 2006

(54) BASEBALL TRAINING SYSTEM AND METHOD

(75) Inventor: John G Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 0 days.

(21) Appl. No.: 10/803,665

(22) Filed: Mar. 18, 2004

(65) Prior Publication Data

US 2005/0209027 A1 Sep. 22, 2005

(51) Int. Cl.
*A63B 69/00* (2006.01)

(52) U.S. Cl. ..... 473/431; 473/422; 473/451; 124/78

(58) Field of Classification Search ..... 473/422, 473/431, 457, 456, 436, 454, 451, 432; 124/7, 124/79, 81, 56
See application file for complete search history.

(56) References Cited

U.S. PATENT DOCUMENTS

| | | | | |
|---|---|---|---|---|
| 849,941 | A | 4/1907 | Titus | |
| 1,086,067 | A | 2/1914 | McMillan | |
| 1,142,184 | A | 6/1915 | Lawrence | |
| 1,170,715 | A | 2/1916 | Westgate | |
| 1,371,867 | A | 3/1921 | Dean | |
| 1,567,384 | A | 12/1925 | Rectenwald et al. | |
| 1,591,753 | A | 7/1926 | Flaugh | |
| 2,251,305 | A | 8/1941 | Tarbox | |
| 2,292,109 | A | 8/1942 | Engel | |
| 2,325,858 | A | 8/1943 | Kellermann et al. | |
| 2,603,203 | A | 7/1952 | Herold | |
| 2,657,058 | A | 10/1953 | Mulcahy | |
| 2,657,931 | A | 11/1953 | Burrell | |
| 2,705,945 | A | 4/1955 | Cavalier | |
| 2,792,822 | A | 5/1957 | Ponza | |
| 2,805,070 | A | 9/1957 | Waters | |
| 2,827,295 | A | 3/1958 | Austin | |
| 2,873,969 | A | 2/1959 | Ziel | |
| 2,895,737 | A | 7/1959 | Blees | |
| 2,944,816 | A | 7/1960 | Dixon | |
| 3,037,776 | A | 6/1962 | Younce | |
| 3,133,733 | A | 5/1964 | Elseroad | |
| 3,260,527 | A | 7/1966 | Younce | |
| 3,306,613 | A | 2/1967 | Mainers | |
| 3,408,071 | A | 10/1968 | Lundy | |
| 3,706,451 | A | 12/1972 | Dixon | |
| 3,821,945 | A | 7/1974 | Foster | |
| 3,911,888 | A * | 10/1975 | Horvath | 124/56 |
| 4,080,950 | A | 3/1978 | Paulson et al. | |
| 4,083,559 | A | 4/1978 | Owen, Jr. | |
| 4,148,555 | A | 4/1979 | Lerman | |
| 4,193,591 | A | 3/1980 | Paulson | |
| 4,372,284 | A | 2/1983 | Shannon et al. | |
| 4,497,485 | A | 2/1985 | Macosko | |
| 4,552,120 | A | 11/1985 | Nall et al. | |
| 4,705,014 | A | 11/1987 | Kahelin | |
| 4,772,017 | A | 9/1988 | Eriksen | |
| 4,883,272 | A | 11/1989 | Lay | |

(Continued)

*Primary Examiner*—Mitra Aryanpour
(74) *Attorney, Agent, or Firm*—Jacox, Meckstroth & Jenkins

(57) ABSTRACT

A baseball training system and method for training a player is shown. The baseball system and method includes a collector for collecting thrown balls and directing them to a throwback unit which has multiple adjusters for adjusting various characteristics of a ball being thrown back. The throwback unit can be adjusted to accommodate different ball sizes to change a trajectory of a ball being thrown back by the throwback unit.

16 Claims, 8 Drawing Sheets

U.S. PATENT DOCUMENTS 4,974,843 A * 12/1990 Henningsson ..... 473/431
5,012,790 A 5/1991 Bates
5,133,548 A 7/1992 Bedord et al.
5,160,131 A * 11/1992 Leon ..... 473/451
5,257,615 A * 11/1993 Jones ..... 124/56
5,485,994 A * 1/1996 Underwood et al. ..... 473/451
5,496,025 A * 3/1996 Phillips et al. ..... 124/56
5,566,934 A 10/1996 Black et al.
5,573,239 A 11/1996 Ryker et al.
5,733,209 A * 3/1998 McIntyre, IV ..... 473/436
5,746,670 A * 5/1998 Brady ..... 473/451
5,776,018 A * 7/1998 Simpson et al. ..... 473/433
5,826,568 A 10/1998 Van Ross, Jr.
6,155,936 A * 12/2000 Dorr ..... 473/456
6,167,878 B1 * 1/2001 Nickerson et al. ..... 124/64
6,379,272 B1 * 4/2002 Gorgo et al. ..... 473/421
6,406,386 B1 * 6/2002 Brazzell ..... 473/431
6,620,064 B1 * 9/2003 Nickerson ..... 473/431

* cited by examiner 15
14
14
15
96
100
20
26
92b
177
108
172
180
132
116
162
166
170
160
142
174
102
98
22
120
122
121
134
136
118
114
L
116
132
20
170
174
20
26
20
92
177

28
36
36a
36b
32a
38a
38
44
34a
48
40a
40
34
42
54
32
62
56
50
62a
62c
62b
64
64a
64c
58
64b
60
76
97
95
B
30
62
50
60
64
θ
190
192

BASEBALL TRAINING SYSTEM AND METHOD

BACKGROUND OF THE INVENTION

1. Field of the Invention

This invention relates to a baseball training and system and method and, more particularly, a baseball training and system training method that comprises a collapsible and portable collector that directs balls to a throwback unit that is capable of providing multiple adjustments to permit a characteristic, such as a ball size capability, ball return trajectory or angle of ball return.

2. Description of Related Art

In the past, various ball throwing devices and nets have been used to assist training a player, especially a pitcher. For example, some of the devices disclose ball throwing devices in which a pair of rotary wheels are independently adjustable in speed to achieve the throwing of a ball with wide variations in velocity and curvature. Also, nets have been used in the past to collect thrown balls. However, there is no known patent or prior art that provides for a system and method that enables automatic collection of the balls and feeding of the balls which returns the balls to the player who throws the balls towards a target on the collector and in which the thrower is adjustable to accommodate balls of different sizes, to adjust the trajectory of balls thrown and which may be utilized in combination with other features, such as a speed sensor which measures a velocity of the ball and a ball sensor which provides an indication to the player when a ball is going to be thrown at him.

SUMMARY OF THE INVENTION

It is, therefore, a primary object of the invention to overcome one or more of the problems associated with the prior art devices by providing a ball pitching system and method that provides multiple adjustments of a characteristic of the ball throwing device, such as a ball trajectory adjustment and a ball size adjustment.

In one aspect, the invention comprises a baseball training system comprising a target, a collector for collecting balls thrown at the target by a thrower a throwback unit associated with said collector for receiving collected balls back to said thrower, said throwback unit comprising a base, a drive motor mounted on said base, a wheel coupled to said drive motor, and a guide, at least one of said wheel or said guide being adjustable to permit adjustment of a characteristic of said baseball training system.

In another aspect, the invention comprises a throwback system comprising a base, a drive motor mounted on said base a wheel coupled to and driven by said drive motor and a guide at least one of said wheel or said guide being adjustable to permit adjustment of a characteristic of said throwback system.

In still another aspect, the invention comprises a method for returning thrown balls to a player, said method comprising the steps of providing a throwback unit, situating said throwback unit in operative relationship with a collector for collecting balls thrown at a target associated with the collector, adjusting said throwback unit to accommodate a desired ball size and adjusting said throwback unit to return a ball along a predetermined ball return trajectory.

These and other objects and advantages of the invention will be apparent from the following description, the accompanying drawings and the appended claims.

DETAILED DESCRIPTION OF PREFERRED EMBODIMENT

Figure 1:
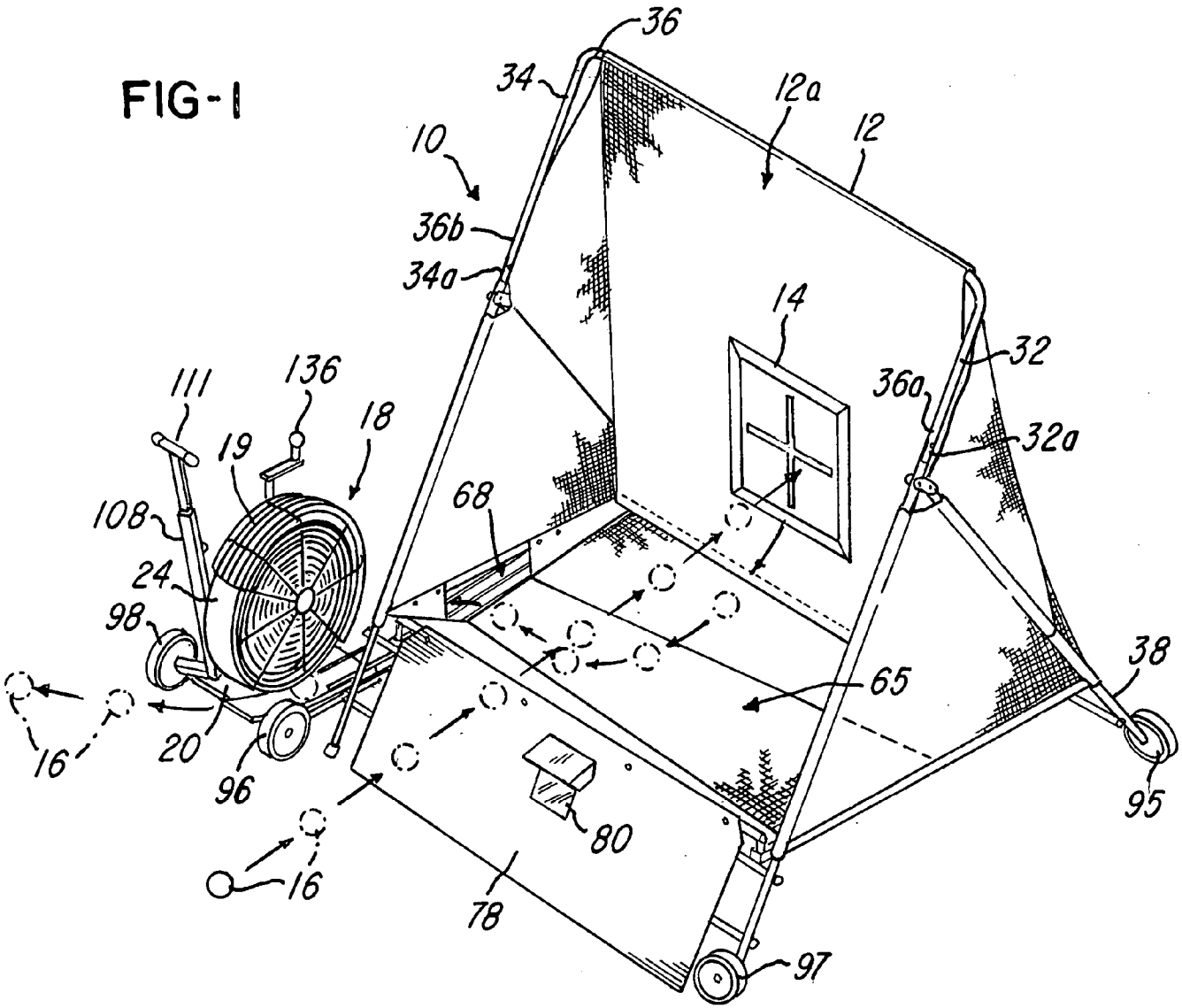
FIG. 1 illustrates a perspective view of an embodiment of the invention.

Referring now to FIG. 1, a baseball training system 10 is shown. The baseball training system comprises a collapsible collector 12 defining a collection area 12*a* and comprising a target 14 at which a player, such as a pitcher or baseball player, may throw a ball 16. The system 10 further comprises a throwback unit 18 comprising a base 20, a drive motor 22 (FIG. 3), and a wheel 24 that is rotatably mounted on a hub 25 (FIG. 11) which is mounted on and rotatably driven by drive motor 22. The hub comprising a first hub member 25*a* and a second hub member 25*b* which are fastened together with a plurality of bolts 29 to retain and support the wheel 24 therebetween. The system 10 further comprises a guide 26 (FIG. 4) that cooperates with the wheel 24 to define an area 27 for receiving the ball 16 to be thrown back to the player as described later herein.

Features of the collector 12 will now be described. As illustrated in FIGS. 16–23, the collector 12 comprises a collapsible frame 28 having a material 30 mounted thereon. The material 30 may comprise or be made of any suitable material that is durable enough to withstand the impact of a ball being thrown at more than 90 miles per hour and yet flexible enough to permit the collector 12 to be folded in the manner described herein. The material 30 is mounted on the frame 28 by providing hems (not shown) along its border through which the frame 28 can be threaded. Alternatively, the material 30 could be provided with VELCRO® brand hook and loop fasteners or snaps along its borders to permit the material 30 to be detachably fastened to the frame 28. This facilitates cleaning the material 30.

Figures 23, 24, 25:
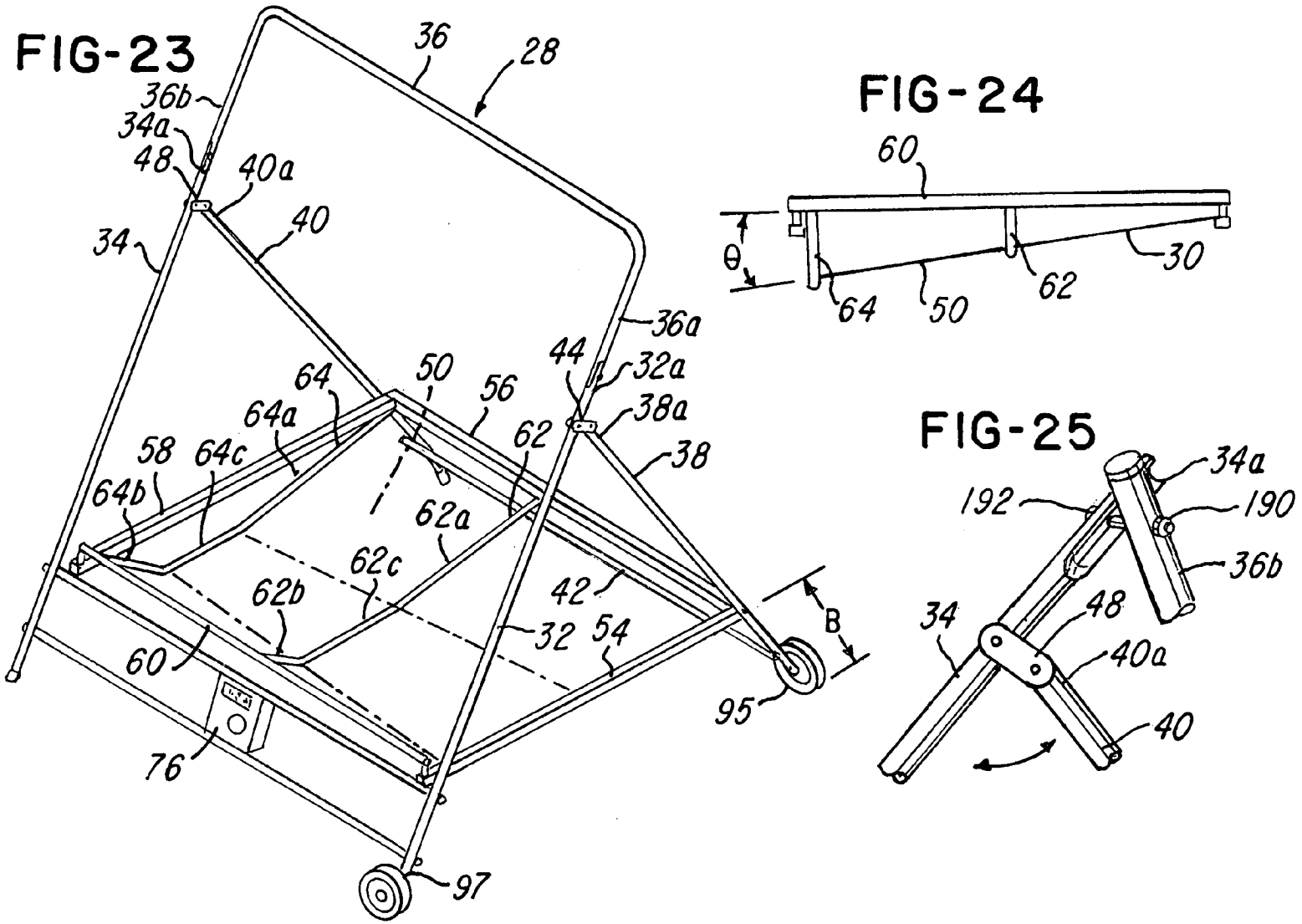
FIG. 23 is a perspective view of the collector showing details of the frame.
FIG. 24 is a fragmentary view showing the angle of tilt associated with the floor which directs collected balls toward an aperture and ultimately toward the throwback unit.
FIG. 25 is a fragmentary view showing means for pivoting the various members.

Referring to FIGS. 23 and 24, the frame 28 comprises a plurality of tubular frame members. Notice that frame members 32 and 34 are joined by a U-shaped member 36 that may be integrally formed with members 32 and 34 to provide a one piece U-shaped tubular construction, or alternatively, the ends 36*a* and 36*b* of member 36 could be provided to telescope either inside or outside of the members 30 or 32 in order to change an overall height H (FIG. 16) of the collector 12. It should be understood that one or more of the tubular members that make up frame 28 that telescope may be provided a plurality of spring-loaded detents (not shown) which cooperate with mating-holes or apertures (not shown) in the mating tubing members as is conventionally known in the camping arts. For example, ends of members 32 and 34 may be provided to have a smaller outer diameter than the inside diameter of ends 36*a* and 36*b* U-shaped member 36 so that it receives the members 32 and 34 to permit the ends 36*a* and 36*b* be easily coupled to 30 and 32, respectively. Thus, detents (not shown) may be provided to lock the member 36 to the members 32 and 34.

The frame 28 further comprises rear tubular members 38 (FIG. 23) and 40 which are joined by a support member 42 and are pivotally coupled to the frame members 32 and 34 with brackets 44 and 48 as illustrated. The pivotal support or bracket 44 (FIGS. 23 and 25) may be provided at the intersections of the various members, such as members 38 and 40, that make up the frame 28 to permit the member 38 to pivot relative to member 32, for example. Likewise, an end 40a of member 40 may be pivotally coupled to bracket 48 in order to permit the frame 28 to be collapsed and stored in the manner described herein.

Although not shown, one or more of the ends 38*a* and 40*a* may comprise spring-loaded detents, which cooperate with apertures or holes in the brackets 44 and 48 to permit the tubular members 38 and 40 to be disassembled from the brackets 44 and 48 in a manner similar to what is conventionally known in camping arts mentioned earlier.

The collector 12 further comprises a floor 50 (FIGS. 16 and 23) that is pivotally coupled between members 38 and 40 and pivots about an axis defined by an arrow in FIG. 23. As best illustrated in FIG. 23, note that the floor 50 is generally rectangular and is defined by a plurality of frame members 54, 56, 58 and 60. Notice that a pair of generally U-shaped frame members 62 and 64 are situated between frame members 56 and 60 as shown. The frame members 62 and 64 support material 30 (FIG. 16) to define a trough or channel 65 (FIG. 1) to direct balls 16 collected in area 12*a* to an aperture or opening 68 (FIGS. 1 and 2) in wall 71.

The frame member 62 comprises a first leg portion 62*a*, a second leg portion 62*b* and a joining portion 62*c* that joins the portions 62*a* and 62*b*. Likewise, the member 64 comprises a first leg portion 64*a*, a second leg portion 64*b* and a joining portion 64*c*. Notice a length of the joining portion 64*c* is shorter than a length of the joining portion 62*c* of member 64 as shown. It should be understood, as viewed in FIGS. 16–20, that the members 54, 56 and 58 and 60 cooperate with the members 62 and 64 to support the material 30 at an angle θ (FIG. 24) such that a trough or channel 65 is defined that terminates at an opening 68 in a wall 71 (FIG. 2) defined by the material 30. Notice in FIG. 24 that the angle θ is on the order of about 5–20 degrees.

The collector 12 further comprises a ball speed sensor 76 (FIGS. 17–20), that measures and displays a speed of the ball 16 thrown at the target 14 in miles per hour (mph). The collector 12 comprises a front panel 78 (FIG. 16) that is pivotally mounted to member 60 and pivotal in the direction of arrow D in FIG. 16 so that the panel 78 may be moved to a stored position shown in FIGS. 17–20. Note that when the panel 78 is in the position illustrated in FIGS. 1 and 16, it is slightly angled relative to the ground so that any thrown balls 16 that hit the panel 78 will be deflected into the collection area 12a of collector 12. Also, notice that the panel 78 may comprise a transparent window 80 to protect the ball speed sensor 76, while permitting the sensor 76 to capture a speed of a thrown ball 16. In the embodiment being described, the panel 80 is generally planar and made of transparent PLEXIGLAS® acrylic sheet to enable the speed to be displayed on a display coupled to the sensor 76.

In the embodiment being described, the collector 12 collapses as will now be described relative to FIGS. 16–22. First, the panel 78 is moved from the down position shown in FIG. 16 to the stored position shown in FIG. 17, and the floor 50 is then pivoted upward in the direction of arrow C (FIGS. 17 and 18) to the upright and stored position shown in FIG. 19.

Figure 19:
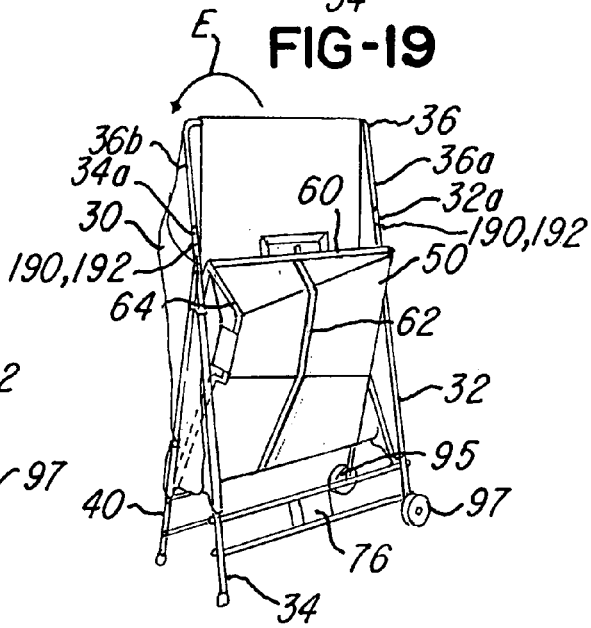
FIG. 19 is a view illustrating various details of the floor showing the floor in the stored position.
Figure 20:
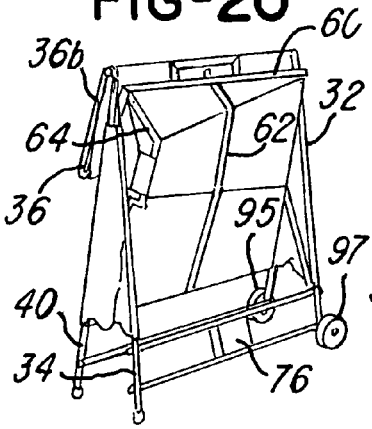
FIG. 20 is a view showing various legs on the collector being moved to a collapsed position, with the top of the collector being folded down to a stored position.

As illustrated in FIG. 20, the frame members 32, 34 and 36 may be moved to a collapsed or closed position shown in FIG. 20. Although not shown, the member 36 may be integral with member 32 or 34 or joined thereto as described earlier herein. The member 36 may be provided separate from members 32 and 34. The ends 32*a* and 34*a* may be provided to comprise a concave shape in cross-section to receive the ends 36*a* and 36*b*, respectively, as shown in FIG. 25. A nut 190 and bolt 192 are used to secure the ends 36*a* to end 32*a* and end 36*b* to end 34*a*. The nut 190 and bolt 192 can be loosened to enable member 36 to be pivoted in the direction of arrow E (FIG. 19) to the closed position shown in FIG. 20. In an alternate embodiment, the member 36 may be pivotally coupled to members 32 and 34 by a bracket (not shown) to be folded down.

Figure 21:
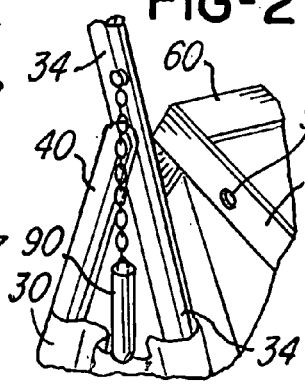
FIG. 21 is a view illustrating means for retaining the floor in a closed and stored position.
Figure 22:
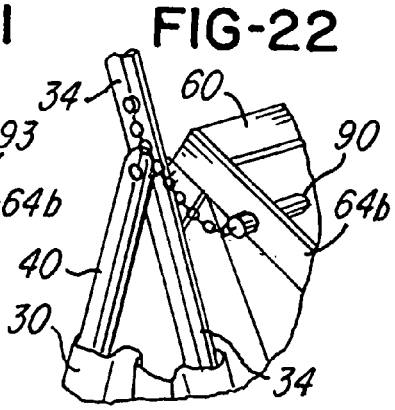
FIG. 22 shows further details of means for locking the floor in a stored position.

After the floor 50 is moved to the stored position shown in FIG. 19, the member 36 of the frame 28 is moved to the collapsed or stored position shown in FIG. 20. If it is desired to lock the floor 50 in a stored position, a retainer 90 (FIG. 21) is provided and may be received in aperture 93, as illustrated in FIGS. 21 and 22. The collector 12 has wheels 95 and 97 (FIG. 1) to permit the user to roll and move the collector 12.

Figure 2:
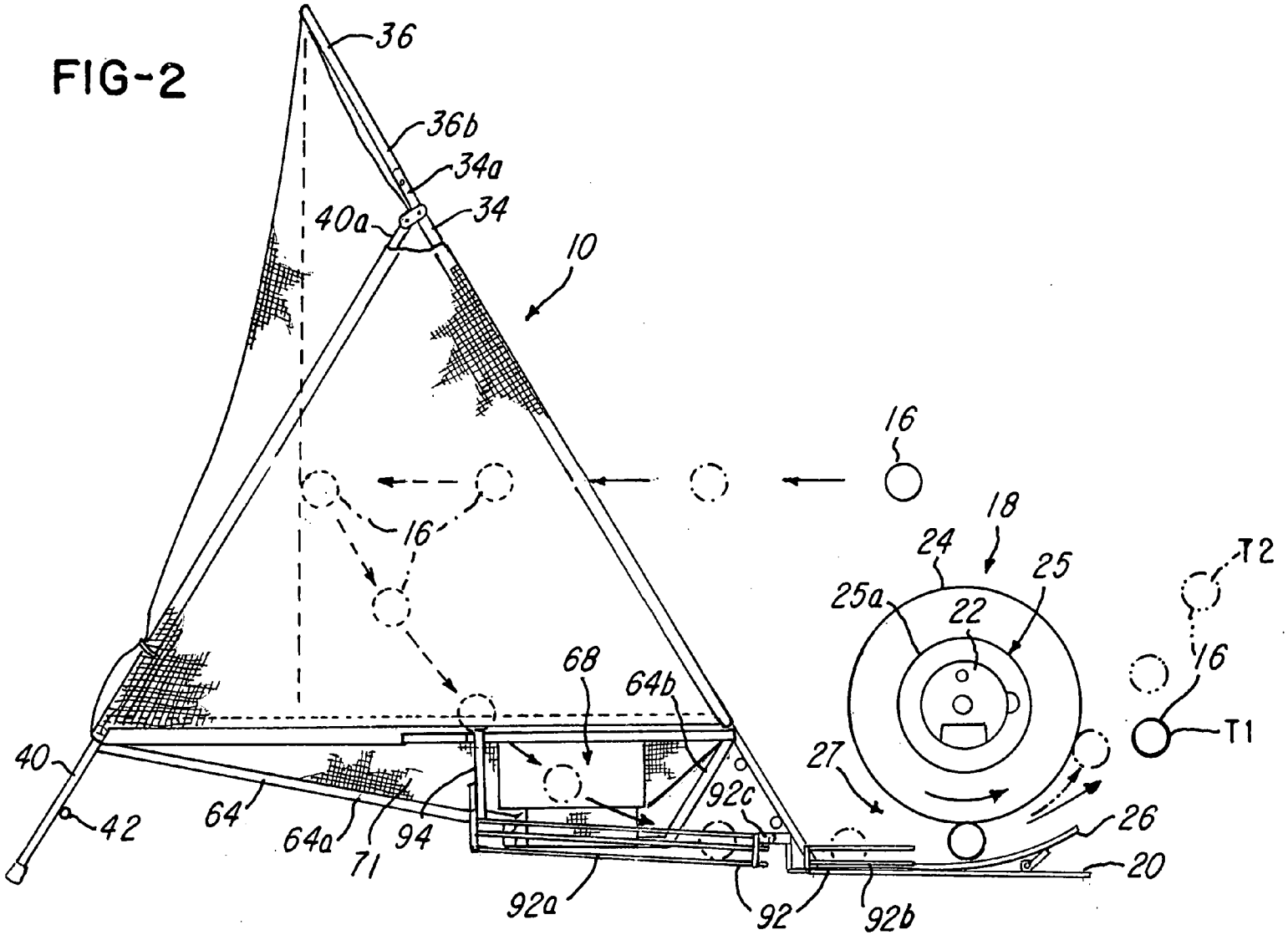
FIG. 2 illustrates a side view illustrating various features of the track which guides balls towards a wheel.

The system 10 further comprises the throwback unit 18 which will now be described. As illustrated in FIG. 1, the throwback unit 18 is situated adjacent to collector 12 and receives collected balls 16 through the aperture 68 of collector 12. The balls 16 are retrieved in a collection track, feed guide or trench (FIGS. 2 and 11), which has a latch or hook 94 that is received by a mating U-shaped channel member 96 (FIG. 2), that is mounted on the member 58 of floor 50, as illustrated in FIG. 2. The track 92 comprises a first track 92*a*, a second track 92*b* and a pivotal coupling 92*c* for coupling the first and second tracks 92*a* and 92*c* together. The coupling 92*c* permits the unit 18 to pivot in the direction of arrows F and G relative to the track 92*a*. The throwback unit may be provided with a cage 19 surrounding wheel 24 as shown in FIG. 1.

Figure 11:
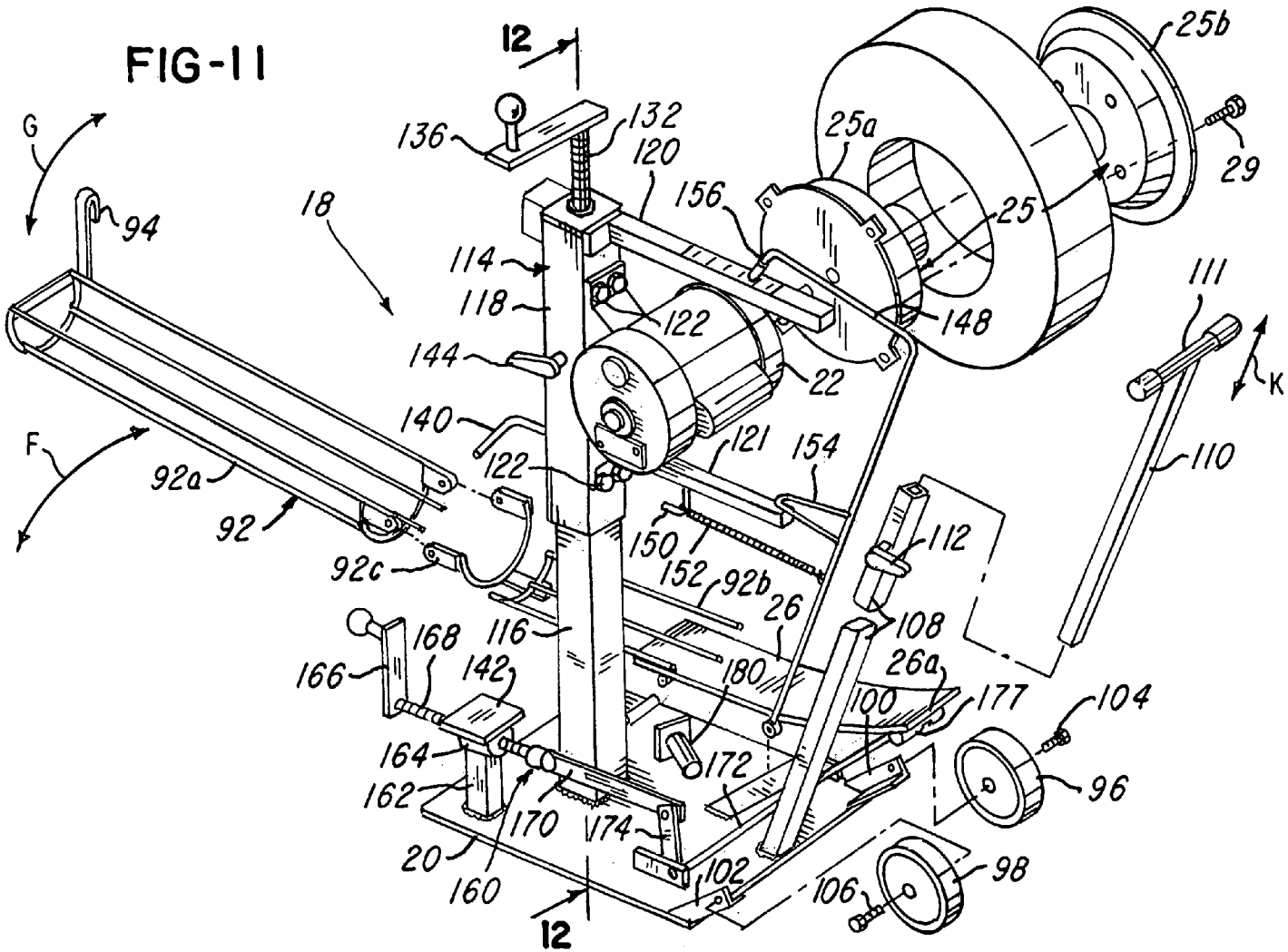
FIG. 11 is an exploded view of the throwback unit.

Referring now to exploded view in FIG. 11, the throwback unit 18 comprises the base 20, which has a pair of wheels 96 and 98 rotatably mounted onto brackets 100 and 102, respectively, with screws 104 and 106. The base 20 further comprises a post 108 on which a tubular handle 110 is mounted and may telescope. The tubular handle 110 comprises a grip 111 and a hand adjustable lock fastener 112 for securing the tubular member 110 to the post 108 after a user adjusts the handle 110 in the direction of double arrow K to a desired height. The grip 111 and wheels 96 and 98 enable the throwback unit 18 to be tilted in the direction of arrow G (FIG. 11) 50 that it can be rolled on the wheels 96 and 98 and moved to a desired location.

The throwback unit 18 further comprises a first adjuster 114 (FIGS. 1 and 12) for adjusting the throwback unit 18 to accommodate different sizes of balls 16. The adjuster 114 comprises a support post 116 having a tubular member 118 adjustably and slidably mounted thereon. The tubular member 118 comprises a pair of brackets or mounts 120 and 121 for providing a ball size as described later herein. The motor 22 is mounted on post 118 with bolts 122 as shown.

Figures 12, 13, 14, 15:
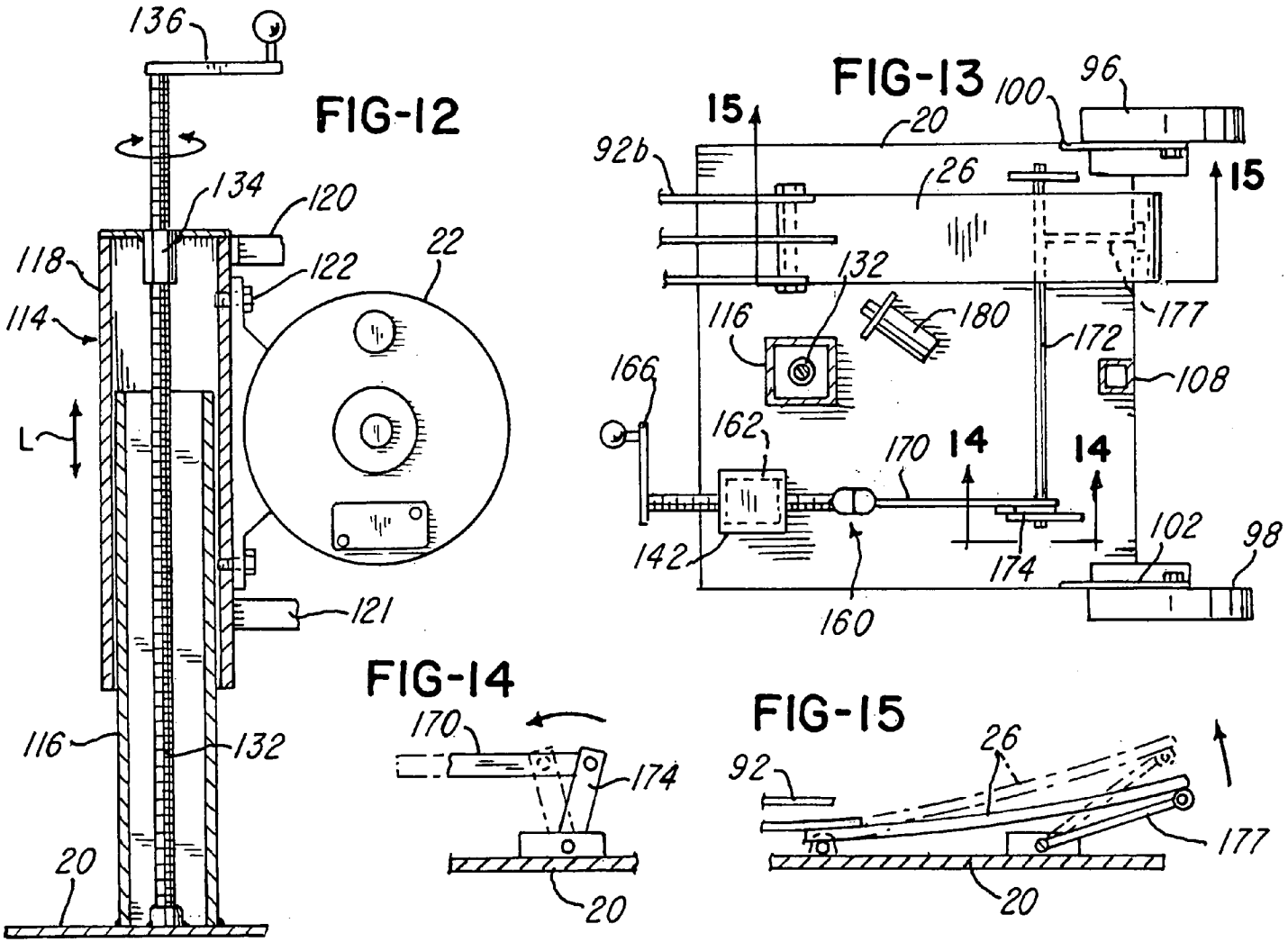
FIG. 12 is a sectional view showing various details of a first adjuster for adjusting a relative position of the wheel relative to the guide and to adjust for a particular ball size.
FIG. 13 is a sectional plan view showing various details of the base and the second adjuster for adjusting a trajectory of a ball being thrown by the throwback unit.
FIG. 14 is a sectional fragmentary view showing linkage for the second adjuster.
FIG. 15 is a sectional fragmentary view showing further details of the second adjuster for changing a position of the guide which, in turn, changes a trajectory of a ball being thrown back by the machine.
Figure 16:
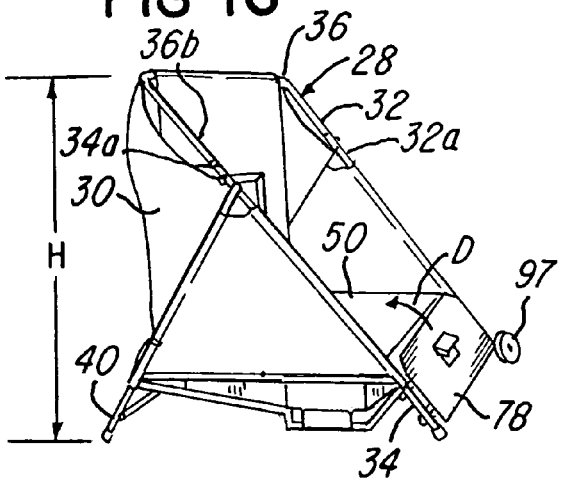
FIG. 16 is a side view of the collector shown in FIG. 1.
Figure 17:
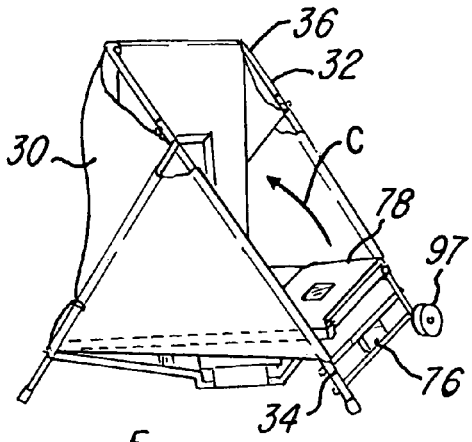
FIG. 17 is a side view similar to FIG. 16 showing a front panel in a stored position and revealing a ball velocity sensor.
Figure 18:
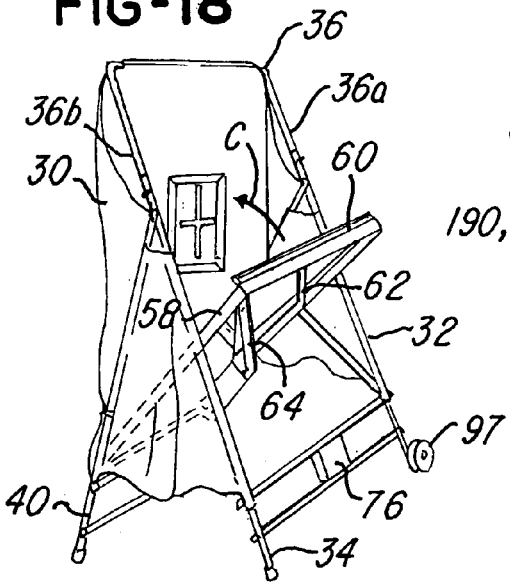
FIG. 18 is a view illustrating the floor being moved to a stored position.

As best illustrated in the sectional view shown in FIG. 12, the first adjuster 114 comprises a threaded member 132 that is threadably received in the threaded sleeve 134 that is integral with tubular member 118 such that when the crank or handle 136 of adjuster 114 is rotated, the tubular member 118 and drive motor 22 move in the direction of double arrow L as shown. After adjustment, a threaded hand tightener 144 (FIG. 11) may be used to lock the members 118 and 116 together.

It should be understood that the adjuster 114 enables the system and method of the present invention to be adjustable in order to accommodate balls of different sizes, such as girls' baseballs used in playing hardball and softball or boys' baseballs used when playing softball or hardball.

Figure 3:
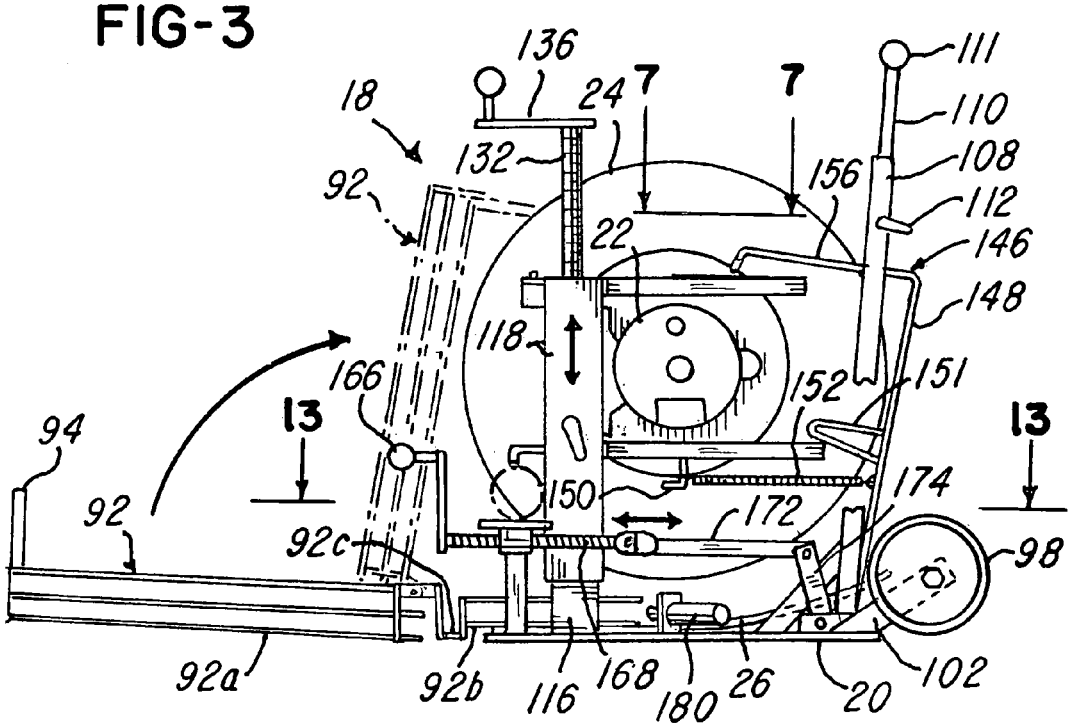
FIG. 3 shows details of a ball adjustment system and ball gauge.
Figure 4:
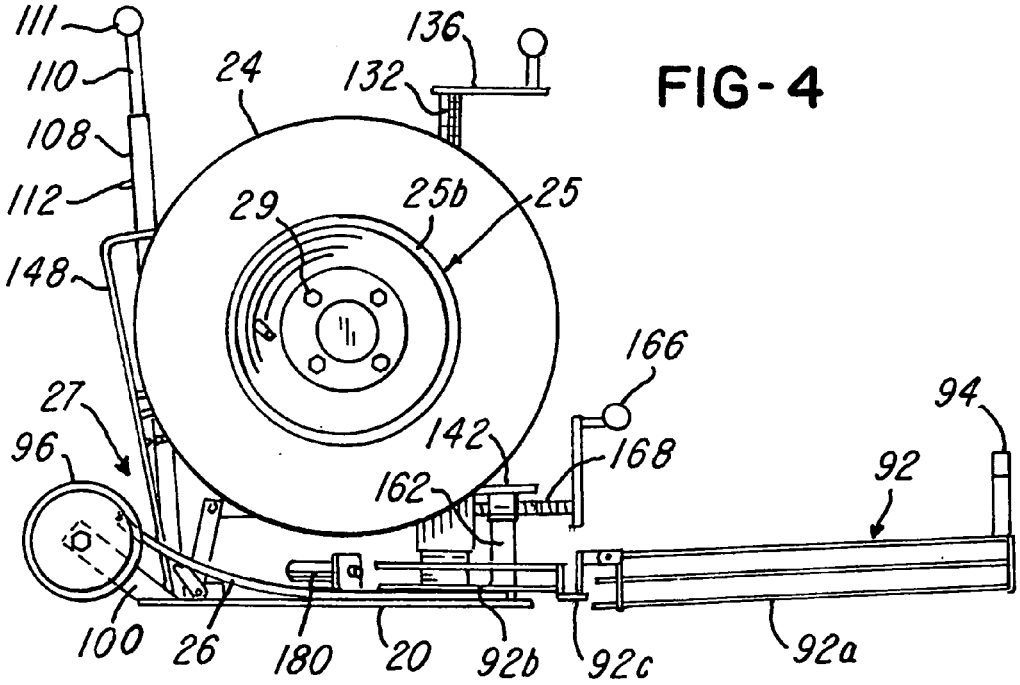
FIG. 4 is a side view of a throwback unit.
Figure 5:
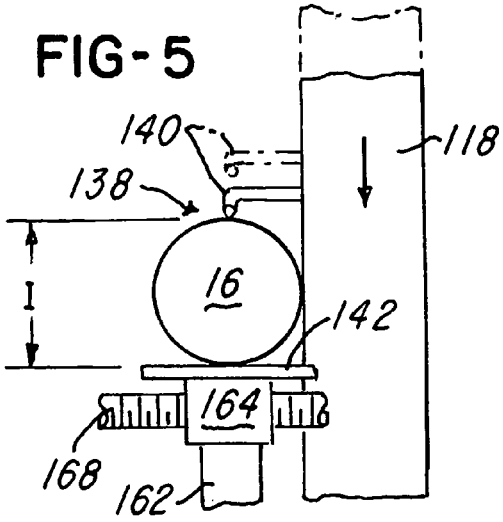
FIG. 5 is a fragmentary view of an adjustment and gauge feature.

As illustrated in FIG. 11, to facilitate measuring a size of the ball 16, the throwback unit 18 further comprises a ball gauge 138 comprised of a first gauge member 140 and a second gauge member 142. The gauge members 140 and 142 receive the ball 16, as illustrated in FIG. 3. The rotatable handle or crank 136 (FIG. 12) is rotated until the members 140 and 142 engage the ball 16 until a distance, indicated by double arrow I in FIG. 5, is set to correspond to the diameter of the ball 16. After the adjuster 114 is set to the appropriate ball size, the threaded hand tightener 144 may be tightened to lock the member 118 to post 116.

The throwback unit 18 further comprises a visual ball-size gauge 146 comprising a pivotal gauge arm 148, as best illustrated in FIG. 3. The arm 148 has an L-shaped spring support 150 that receives a spring 152 that biases the arm 148 toward the tubular member 118 as shown. It should be understood that when the crank or handle 136 is rotated such that the tubular member 118 move in the direction of arrow L shown in FIG. 12, the bracket 121 cooperates with a projection 154 mounted on arm 148 to cause an indicator 156 to move along a top surface of bracket 120. The indicator 156 cooperates with indicia 158 (FIGS. 7 and 10) to provide an indication of the size of ball 16 that is situated between the gauge and members 140 and 142 (FIGS. 5 and 8). For example, note in FIGS. 5–7, a ball 16 is situated between the gauge members 140 and 142 as shown. The crank 136 is rotated until the members 140 and 142 engage the ball 16 and the distance I generally corresponds to the diameter of the ball 16, which in turn causes a distance J (FIG. 6) between the wheel 24 and the guide 26 to be adjusted to correspond to the size of ball 16. Indicator 156 cooperates with indicia 158 to provide a ball size indicator.

Figure 6:
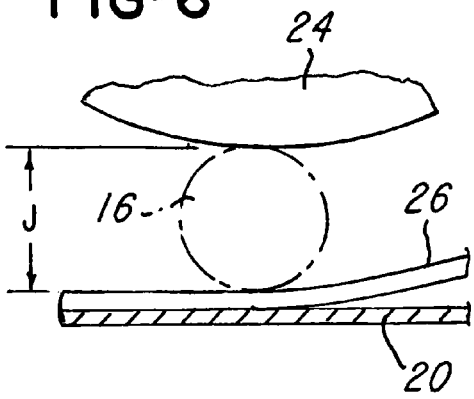
FIG. 6 is a view illustrating the adjustment of a wheel relative to a guide for a first ball having a first size.
Figure 7:
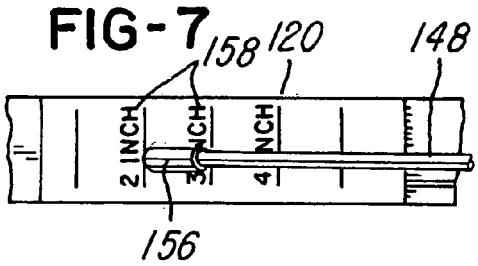
FIG. 7 illustrates an indicator which provides an indication of the ball size for the first ball.
Figure 8:
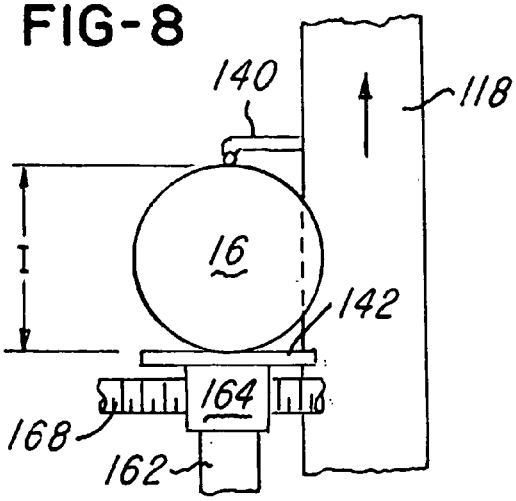
FIG. 8 is a view of an adjustment and gauge feature for a second ball size.
Figure 9:
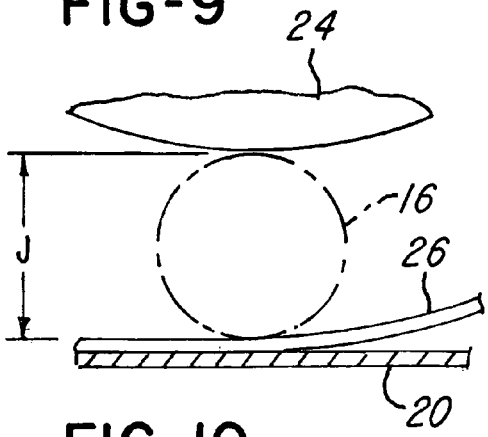
FIG. 9 is a view similar to FIG. 6 showing the adjustment of the ball throwback unit for the second ball.
Figure 10:
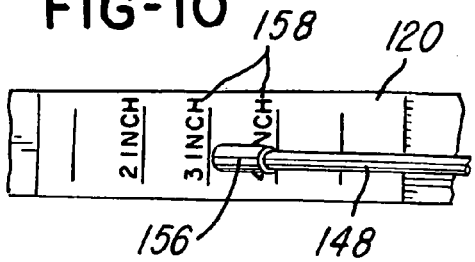
FIG. 10 is a view of an indicator indicating the size for the second ball shown in FIG. 9 after the throwback unit is adjusted for the second ball size.

Further to the illustration, FIGS. 8–10 show a ball 16 of a larger diameter than that shown in FIGS. 5–7. In this illustration, the rotatable crank 136 (FIG. 3) is rotated until the gauge members 140 and 142 are adjusted such that the height H generally corresponds to the diameter of the ball 16. As with the illustration discussed earlier herein relative to FIGS. 5–7, the distance J between the wheel 24 and guide 26 is simultaneously adjusted to the correct ball size. As with the illustration in FIGS. 5–7, note that the indicator 156 (FIG. 10) also simultaneously moves and cooperates with the indicia 158 to provide an indication of the ball 16 size. As with the smaller ball shown in FIGS. 5–7, the indicator 156 and indicia 158 may be used to provide an initial rough adjustment of the distance J (FIGS. 6 and 9) to the desired ball 16 size by rotating the crank 136 and using the indicia 156 to adjust the distance between the wheel 24 and guide 26. Next, finer adjustments may be made by actually placing a ball 16 between the gauge members 140 and 142 and rotating the crank 136 to the desired ball size.

The system 10 further comprises a trajectory adjuster 160 (FIG. 13) which will now be described. The trajectory adjuster 160 provides adjustment to enable a user to launch or return the ball 16 along a pre-determined trajectory. For example, FIG. 2 illustrates the trajectory adjuster 160 being set such that it launches a ball 16 along a first trajectory T1. The trajectory adjuster 160 can be adjusted in the manner described herein to cause the ball to be launched on a different desired trajectory, such as the illustrated trajectory T2 shown in FIG. 2. FIG. 13 illustrates a sectional plan view of the base 20 showing various details of the trajectory adjuster 160 which will now be described.

The trajectory adjuster 160 comprises a post 162 (FIGS. 11 and 13) comprising a threaded nut 164 (FIG. 11) mounted by conventional means, such as a weld, underneath the second gauge meter 142

A rotatable handle or crank 166 rotatably drives the threaded member 168 which cooperates with the nut 164 to drive linkage 170 which, in turn, pivotally drives a connector member 172. This causes a pivot linkage member 174 (FIG. 11) to drive a connector 173 that causes a guide 26 actuator 177 to engage surface 26*a* of guide 26, thereby raising and lowering the guide 26, as illustrated in FIG. 15. Thus, when a user rotates the crank 166 in a counterclockwise direction, for example, the linkage 170 is pulled toward the nut 164. This, in turn, causes the pivot member 177 to engage the surface 26*a* of guide 26 and move it away from the base 20, thereby causing the ball 16 to be returned to the player at the higher trajectory, such as trajectory T2 illustrated in FIG. 2. Likewise, if it is desired to lower the trajectory, for example, to the trajectory T1 illustrated in FIG. 2, then the user rotates the crank 166 in a clockwise direction which, in turn, causes the guide 26 to lower.

It has been found that it may be necessary or desired to adjust the ball height adjuster 114 after the trajectory adjuster 160 has been set. It should be understood, however, that a user may adjust one or both of the ball height adjuster 114 or the trajectory 160 as necessary to adjust the throwback unit 18 to the desired ball size and ball return trajectory.

Advantageously, this system and method provide a convenient baseball training system and method that provides a portable and collapsible collector 12 with a portable ball return or throwback unit 18. During use, a player may throw the ball 16 at the target 14. The ball 16 falls into the collection area 12*a* provided by the collector 12 and the angled floor 50 causes the ball 16 to be directed toward the aperture 68 in sidewall 71. The ball 16 falls onto the feed guide track or trench 92 (FIG. 2), whereupon it is directed toward an area 27 (FIGS. 2 and 4) between the guide 26 and wheel 24.

The rotating wheel 24 cooperates with the guide 26 to return or throw the ball 16 back toward the player. In this regard, it should be understood that the throwback unit 18 may be coupled to the collector 12 with the latch 94 (FIG. 2) as described earlier. The pivotal coupling 92*c* permits the track member 92*a* to pivot in the direction of arrow F (FIG. 11) relative to base 20. This enables the base 20 to be pivoted toward different players in the field of play, as well as toward a player located in front of the collector 12.

As mentioned earlier herein, the system 10 further comprises a speed sensor measure 76 (FIG. 17) which measures the speed of an incoming thrown ball 16 through the transparent window 80 (FIG. 1) and displays the measurement through the window 80 to the player. Alternatively, a separate display, such as a larger liquid crystal display may be coupled to sensor 76 and situated adjacent to the collector 12 to provide a read-out display or display of the speed of the ball 16 thrown at the target 14.

Although not shown, a computer (not shown) may be coupled to sensor 76 to collect data regarding pitches thrown toward target 14.

Moreover, the system 10 may be provided with a ball load sensor 180 (FIGS. 3, 4 and 11) which senses when a ball 16 is situated in the area 27 between the guide 26 and the wheel 24 and is about to be returned. The system 10 further comprises an audio output speaker (not shown) coupled to the sensor 180 which provides an audible sound when the ball 16 is loaded between the guide 26 and wheel 24. In the embodiment being described, the motor 22 may be model number 2130 available from Leeson Electric of Willoughby, Ohio, the speed sensor 76 is a model number Speed Check available from Speed Check, of Edina, Minn.; and sensor 180 is a model number PA18 available from Carlos Gavazzi of Cleveland, Ohio. Each of the motor 22, sensor 76 and sensor 180 is coupled to a suitable power source with suitable electrical connectors, all of which are not shown for ease of illustration.

Advantageously, this system provides a convenient means and method for providing a portable throwback unit 18 that can be situated in operative relationship with a portable and collapsible collector 12. The throwback unit 18 can be adjusted to accommodate numerous ball sizes and can also be adjusted to return a ball along a pre-determined ball return trajectory. The baseball training system 10 can be used to return thrown balls to a player or multiple players by simply adjusting the location of the throwback unit 18. Also it is envisioned that the unit 18 can be used as a field training device such that the throwback unit 18 can be positioned to throw balls 16 along different trajectories and any desired angle of ball 16 return relative to the collector 12. Because the base 20 can be pivoted relative to the track 92, a trainer can use the grip 111 to adjust the position of the throwback unit 18 to direct it towards the player in the field. After the throwback unit 18 throws the ball 16 towards a first player, for example, the throwback unit 18 can be adjusted or moved so that it throws the ball 16 towards a second player in the field. For example, ground balls 16 may be thrown at a player in the infield or outfield who throws the balls 16 back toward target 14 and into the collection area 12*a* of collector 12, which again throws the balls to the player on the pre-determined or desired trajectory. Also, the trajectory can be altered as desired herein to throw line drives, shallow pop-ups, or ground balls.

While the system and method described herein constitute preferred embodiments of this invention, it is to be understood that the invention is not limited to this precise system and method, and that changes may be made in either without departing from the scope of the inventions, which is defined in the appended claims.

What is claimed is:

1. A baseball training system comprising the following in combination:

a collector having a target, said collector receiving and collecting baseballs thrown at said target by a baseball player;

a throwback unit associated with an exit opening in said collector for receiving collected baseballs from said collector and for throwing said baseballs, one at a time, back to said baseball player, said collector having a floor for urging baseballs thrown at said target toward said exit opening in the collector;

said throwback unit comprising:

a base;

a drive motor mounted on said base;

a wheel driven by said drive motor; and a guide situated on the ground and adjacent to said exit opening for receiving baseballs passing through said exit opening, at least one of said wheel or said guide being adjustable to permit adjustment of a characteristic of said baseball training system; wherein said characteristic of said baseball training system comprises one of a throwback trajectory of a baseball thrown by the throwback unit or a baseball size for a baseball to be thrown back by the throwback unit;

said throwback unit causing said baseballs that are thrown at said target to be thrown upward away from the ground and toward the baseball player:

said collector further comprising a collapsible frame and at least one wheel rotatably mounted thereon to enable the collector to be moved.

2. The baseball training system as recited in claim 1 wherein said throwback unit comprises a baseball size adjuster coupled to at least one of said wheel or said guide for adjusting a relative distance between said wheel and said guide to accommodate baseballs having different circumferences.

3. The throwback system as recited in claim 1 wherein said system further comprises:

a guide adjuster coupled to said guide for adjusting a position of said guide relative to said wheel in order to change a trajectory of a baseball thrown back to said player by said throwback unit.

4. The throwback system as recited in claim 3 wherein said system comprises:

a motor mount on which said drive motor is mounted;

a baseball size adjuster coupled to said wheel for adjusting a position of said wheel in response to a baseball size.

5. The throwback system as recited in claim 1 wherein said baseball size adjuster comprises:

a motor mount on which said drive motor is coupled;

a baseball size adjuster coupled to said wheel for adjusting a position of said wheel in order to move said wheel towards and away from said guide.

6. The baseball training system as recited in claim 4 wherein said adjuster comprising a rotatable crank for raising and lowering said wheel to said guide.

7. The baseball training system as recited in claim 2 wherein said baseball size adjuster comprises a preset gauge for receiving a baseball to be thrown back, said preset gauge gauging a size of said baseball so that when said baseball size adjuster is adjusted to a size of said baseball, a distance between said guide and said wheel is set, said distance generally corresponding to said size.

8. The baseball training system as recited in claim 2 wherein said system comprises an indicator for indicating a distance between said wheel and said gauge, said distance generally corresponding to a size of the baseball.

9. The baseball training system as recited in claim 1 wherein said guide comprises a track for guiding baseballs from said exit opening toward said wheel, said collector comprising a floor that is angled relative to the ground in order to direct baseballs toward said track of said throwback unit.

10. The baseball training system as recited in claim 1 wherein said throwback unit is portable and detachable from said collector.

11. The baseball training system as recited in claim 10 wherein said throwback unit comprises a handle and at least one throwback wheel rotatably coupled to said base to enable the throwback unit to be moved.

12. The baseball training system as recited in claim 1 wherein said throwback unit comprises a handle and at least one throwback wheel rotatably coupled to said base to enable the throwback unit to be moved.

13. The baseball training system as recited in claim 1 wherein said system comprises:

a speed measure coupled to a front of the collector for measuring a speed of a baseball thrown at said target.

14. The baseball training system as recited in claim 1 wherein said speed measurer is mounted on said collector.

15. The baseball training system as recited in claim 1 wherein said collector comprises a floor that is angled relative to the ground in order to direct-balls baseballs to the throwback unit.

16. The baseball training system as recited in claim 1 wherein said throwback system comprises at least one wheel mounted on said base for moving said throwback system.

* * * * *